United States Patent [19]

Senge et al.

[11] 4,045,306

[45] Aug. 30, 1977

[54] ELECTROPLATING ZINC AND BATH THEREFOR

[75] Inventors: Gerd Senge; Günter Voss, both of Berlin, Germany

[73] Assignee: Schering Aktiengesellschaft, Berlin, Germany

[21] Appl. No.: 691,625

[22] Filed: June 1, 1976

[30] Foreign Application Priority Data

June 4, 1975 Germany ..... 2525264

[51] Int. Cl.[2] ..... C25D 3/22; C25D 3/24

[52] U.S. Cl. ..... 204/55 R

[58] Field of Search ..... 204/55 R, 55 Y, 43 Z, 204/44, 114

[56] References Cited

U.S. PATENT DOCUMENTS

| | | | |
|---|---|---|---|
| 3,954,575 | 5/1976 | Yanagida et al. | 204/55 R |
| 3,974,045 | 8/1976 | Takahashi et al. | 204/55 R |

FOREIGN PATENT DOCUMENTS

| | | | |
|---|---|---|---|
| 307,115 | 6/1971 | U.S.S.R. | 204/55 R |

*Primary Examiner*—G. L. Kaplan

*Attorney, Agent, or Firm*—Joseph F. Padlon

[57] ABSTRACT

An alkaline - cyanide free or substantially cyanide-free bath is provided for the electrodeposition of a bright levelled zinc coating; said bath containing a zinc salt, alkali hydroxide and conventional additives and a reaction product of unsaturated nitrogen heterocyclic hydrocarbon compounds containing at least two nitrogen atoms in the ring with epihalogen hydrin or glycerol halogen hydrin.

6 Claims, No Drawings

ELECTROPLATING ZINC AND BATH THEREFOR

The invention concerns an alkaline cyanide-free or substantially cyanide-free zinc bath for electrodepositing bright to extra bright levelled zinc coats on a substrate.

It is known that alkaline zinc baths have been used containing less toxic sequestrants instead of the highly toxic alkali cyanides. These sequestrants are said to permit a zinc deposit which is satisfactory for practical purposes when used in combination with the more unstable zinc complex for zinc deposits.

To this end it has been suggested, for example, to use gluconates (cf. German Pat. No. 1,253,002); alkanol amines and hexamethylene tetramine (cf. German Pat. No. 1,150,255); surfactants with imidazolinium basic substances, in addition to gelatin and aldehydes (cf. German Pat. No. 1,496,742); longer chain amines in mixture with other additives (cf. German Pat. No. 1,935,821); and reaction products of alkylene polyamines with epihalogen hydrines (cf. German Pat. No. 1,771,371).

It has been found that all these additives have not been satisfactory. The apparent disadvantage being that they must either be in such high concentrations that problem-free waste water detoxification is no longer assured, or that they can no longer be handled safely, because of their low stability and the increased risk of waste water detoxification by the formation of sequestring decomposition products. Other disadvantages are that the high concentration of the decomposition products has a negative effect on the corrosion resistance of the zinc deposits and may lead to annoying and undesired precipitations in the electrolyte.

With the above in view, it is an object of the present invention to provide an alkaline zinc bath which, while avoiding the disadvantages of the known alkaline zinc baths, permits the deposit of bright to extra bright levelled zinc coats, and which insures a high stability and problem-free waste water detoxification with a low concentration of the additives.

This problem is solved according to the present invention by an alkaline cyanide-free or substantially cyanide-free zinc bath which contains a zinc salt, alkali hydroxide and conventional additives, and which is characterized in that it contains a reaction product of an unsaturated heterocyclic hydrocarbon compound containing at least two nitrogen atoms in the ring, with an epihalogen hydrin or with a glycerolhalogen hydrin.

The bath according to the invention has excellent properties. It forms an excellent bright coat, and shows an unusually high leveling capacity for alkaline baths. The stability is very high, so that no disturbing decomposition products are formed, even after prolonged operation. The content of the reaction product to be used according to the invention for the operation is so low that zinc solutions and solutions containing copper- or nickel salts no longer have a sequestring effect at the very low electrolytic dilutions of 1:10.

Zinc salts that can be used are, for example, zinc sulfate, zinc acetate, zinc oxide and others, in concentrations of 4.0 to 20.0 g/liter, preferably 6.0 to 15.0 g/liter, related to the zinc metal. The alkali hydroxide, preferably sodium hydroxide, is added to the bath in such amounts that the pH-value is substantially above 12. In addition, alkali carbonates can also be present in the bath in amounts up to 100 g/liter.

The reaction products to be used according to the invention represent partly quaternized monomeric or polymeric compounds which have a molecular weight of more than 150, preferably 200 to 100,000. They are effective in concentrations of 0.01 g/liter and can generally be used in concentrations of 0.1 to 100 g/liter, preferably 0.5 g to 20 g/liter.

The above mentioned reaction products are produced according to known methods, for example, by reacting the unsaturated heterocyclic hydrocarbon compound containing at least two nitrogen atoms with the halogen hydrin in a solvent.

The unsaturated heterocyclic compound is placed, for example, in molar concentration in water or a solution of water and ethyl alcohol, and the epihalogen hydrin or glycerol halogen hydrin is added at room temperature in portions. The molar ratio between heterocyclic compound and halogen hydrin is preferably 2:1 to 1:4. The reaction temperature can vary between 20° and 80° C depending on the substance used.

After the reaction is completed, the mixture is stirred for one hour at boiling temperature, and then diluted with water to the desired concentration.

Suitable heterocyclic hydrocarbon compounds that may be used are unsaturated five- or six-member compounds, of which the following are included by way of example: pyrazol, imidazol, 1,2,3-triazol, tetrazol, pyridazine, pyrimidine, pyrazine, 1,3,5-triazin, tetrazine, benzimidazol, purine, quinoxaline, pteridine, 1,2,3-oxadiazol, 3-amino-1,2,4-triazol, 1,3,4-thiadiazol, 1,2,4-thiadiazine, benzothiadiazine, 5,5'-(bis-imidazolyl)-methane, 1,2,4-triazol, 1-acetyl imidazol, 2-methyl-imidazol, 4-amino-imidazol and derivatives thereof.

The following table illustrates typical reaction conditions by way of example:

| Unsaturated heterocyclic hydrocarbon compound molar in solvent | Molar ratio of heterocyclic compound to epihalogen hydrin or glycerol halogen hydrin | Solvent | Reaction temperature/ reaction time |
|---|---|---|---|
| 1. Pyrazole | 1 : 1 | Water | 20° C to boiling temperature 1 to 24 hours |
| 2. 3-Amino-1,2,4-triazol | 1 : 4 | Water | 20° C to boiling temperature 1 to 24 hours |
| 3. 1,2,4-Triazol | 1 : 3 | Water | 20° C to boiling temperature 1 to 24 hours |
| 4. Benzimidazol | 1 : 1 | Water/ alcohol | 20° C to boiling temperature 1 to 24 hours |
| 5. Tetrazine | 1 : 4 | Water | 20° C to boiling temperature 1 to 24 hours |
| 6. 5,5'-(bis-imidazolyl)-methane | 1 : 2 | Water | 20° C to boiling temperature 1 to 24 hours |
| 7. 1,3,4-thiadiazol | 1 : 1 | Alcohol | 20° C to boiling temperature 1 to 24 hours |
| 8. 1-Acetyl-imidazol | 1 : 0.5 | Water | 20° C to boiling temperature 1 to 24 hours |
| 9. 2-Methyl-imidazol | 1 : 2 | Water | 20° C to boiling temperature |

-continued

| Unsaturated heterocyclic hydrocarbon compound molar in solvent | Molar ratio of heterocyclic compound to epihalogen hydrin or glycerol halogen hydrin | Solvent | Reaction temperature/ reaction time |
|---|---|---|---|
| | | | 1 to 24 hours. |

The reaction products are light yellow to dark brown, monomeric or polymeric compounds which are easily soluble in water. They have a molecular weight of more than 150 to about 100,000 and more. A special advantage is that they can be added to the bath without isolation from the reaction mixture. The basic composition of the bath according to the invention is as follows:

| | |
|---|---|
| zinc salt: | 4.0 to 20.0 g/liter, preferably 6.0 to 15.0 g/liter related to the zinc metal |
| alkali hydroxide | 50.0 to 250.0 g/liter, preferably 80.0 to 160.0 g/liter |
| reaction product from unsaturated heterocyclic hydrocarbon compound and halogen hydrin in aqueous solution. | 0.1 to 100 g/liter, preferably 0.5 to 20.0 g/liter |

The bath may also contain common additives, with which the effects of the reaction products to be used according to the invention can be surprisingly increased.

Such additives are, for example: sulfur compounds, such as organic or inorganic sulfur compounds with a bivalent sulfur atom, aliphatic or aromatic aldehydes or ketones, aliphatic or aromatic amines, polyvinyl alcohol, polyvinyl pyrrolidon, water soluble proteins or reaction products of halogen hydrin, that is, epihalogen hydrins and/or glycerol halogen hydrins, with aliphatic or aromatic amines or heterocyclic mononitrogen compounds alone or in mixture with each other.

Of these common additives, the aldehydes and ketones have a particular improving effect in relatively low concentrations, which are below those concentrations at which they otherwise show no effect, so that secondary reactions which reduce the active substance, are avoided.

The bath according to the invention has the particular advantage that it can be operated free of the known harmful sequestrants.

But if it is desirable to use these sequestrants in the bath composition according to the invention, this can be done without much harm, because very small amounts are already sufficient for any desired sequestration of the zinc, which have no effect on the quality of the coats deposited according to the invention. Suitable as such ordinary sequestrants are those of the class of the aminocarbonic acids, of the organic phosphonic acids, of the polycarbonic acids, and of the cyanides.

The bath according to the invention is used at current densities of 0.01 to 10 A/qdm, preferably 0.1 to 6 A/qdm, and at temperatures of about 20° to 40° C. It can be used for galvanizing racks, drums or bells on ordinary base materials, such as iron and steel.

The following examples will illustrate the invention.

EXAMPLE 1

A cyanide-free alkaline zinc bath of the following composition was prepared:

20 g/l zinc oxide
120 g/l sodium hydroxide
0.1 g/l veratrum aldehyde
0.5 g/l benzimidazolthiol This mixture was electroplated in a Hull cell (volume 260 ml) at 20° C and a current intensity of 1 A for 10 minutes on a scratched sheet iron cathode.

RESULT

There was a grey to black deposit over a wide current density range and scorchings in the high current density range. After adding 4 to 8 ml/l of a molar solution, corresponding to 0.6 to 1.2 g/l of a reaction product of pyrazol and epichlorohydrin, an extra bright to bright zinc coat was deposited under the same conditions in the current density range of 0.1 to 4.0 A/qd.

EXAMPLE 2

A zinc bath of the following composition:

60 g/l zinc sulfate crystals
150 g/l sodium hydroxide
1 g/l anise aldehyde bisulfite
1 g/l thiourea was tested in a Hull cell as in example 1.

RESULT:

There was a similar unsuitable zinc deposit. After adding 4 to 8 ml/l of a molar solution, corresponding to 0.7 to 1.4 g/l, of a reaction product of 3-amino-1,2,4-triazol and epichlorohydrin, an extra bright, levelled zinc coat was deposited under the same conditions in the current density range of 0.1 to 4 A/qdm.

EXAMPLE 3

A zinc bath of the following composition:

25 g/l zinc oxide
250 g/l sodium hydroxide
0.5 g/l piperonal
0.5 g/l 2-thiazolinethiol
0.2 g/l polyvinyl alcohol was tested in a Hull cell as in example 1.

RESULT

There was a dark, amorphous deposit in the high to medium current density range. A grey dull deposit was evident in the entire current density range.

After adding 4 to 8 ml/g of a molar solution, corresponding to 0.65 to 1.3 g/l, of a reaction product of 1,2,4-triazol end epichlorohydrin, an extra bright levelled zinc coat was deposited under equal conditions in the current density range of 0.3 to 4 A/qdm.

EXAMPLE 4

A zinc bath of the following condition:

10 g/l zinc oxide
90 g/l sodium hydroxide
0.5 g/l polyvinyl glycol
0.01 g/l 2-mercapto pyrimidine
1 g/l 3-hydroxy-4-(2-hydroxy-ethoxy)-benzaldehyde was used as a drum zinc bath. With a current density of 0.5 to 0.8 A/qdm, electroplating was done at 20° C for 45 minutes. As drum ware were used iron screws.

RESULT

Light-colored, uniform zinc deposits without a pronounced high polish. After adding 2 to 6 ml/g of a solution which contains as a reaction product a compound of 1 mole 1-acetyl imidazol and 0.5 mole epichlorohydrin, corresponding to 0.3 to 0.9 g ration product/-liter, an extra bright levelled zinc coat was deposited.

EXAMPLE 5

A zinc bath of the following composition:
50 g/l zinc sulfate cryst.
100 g/l sodium hydroxide
0.2 g/l thiosemicarbazide
0.2 g/l anise aldehyde
1 g/l vaniline
were used in the drum as in example 1.

RESULT

Irregular mottled half lustre on the iron sheet cathode.

After adding 2 to 6 ml/liter of a solution which contained as a reaction product a compound of 1 mole 2-methylimidazol and 2 moles epichlorohydrin, corresponding to 0.5 to 1.5 g reaction product/liter, an extra bright, levelled zinc coat was deposited.

EXAMPLE 6

A zinc bath of the following composition:
15 g/l zinc oxide
150 g/l sodium hydroxide
30 g/l sodium tetraborate
2 g/l 3 ethoxy-3-methoxy-benzaldehyde
0.5 g/l polyvinyl alcohol
was tested in a Hull cell as in example 1.

RESULT

Grey, dark brown deposit in the high to medium current density range. Mottled half-lustre in the low current density range.

After adding 4 to 8 ml/g of a molar solution, corresponding to 0.7 to 1.4 g/l, of a reaction product of 4-amino-imidazol and epichlorohydrin, there was obtained an extra bright levelled zinc deposit under equal conditions in the current density range of 0.1 to 4 A/qdm.

EXAMPLE 7

A zinc bath of the following composition:
10 g/l zinc oxide
90 g/l sodium hydroxide
0.5 g/l thioacetamide
0.5 g/l benzoyl acetone
was tested in a Hull cell as in example 1.

RESULT

In the entire current density range there resulted a dull dark zinc deposit. After adding 8 ml/l of a molar solution, corresponding to 1.2 g/l, of a reaction product of pyrazol and epichlorohydrin, we obtained a bright zinc deposit under equal conditions in the current density range of 0.5 to 3 A/qdm.

After adding 0.5 g/l polyethylene, the uniformity of the deposit could be visibly increased.

EXAMPLE 8

A zinc bath of the following composition:
20 g/l zinc oxide
160 g/l potassium hydroxide
1 g/l gelatin
1 g/l anise aldehyde
was tested in a Hull cell as in example 1.

RESULT

A dark grey deposit, without lustre, in the entire density range resulted.

After adding 20 ml/g of a solution containing a reaction product of 1 mole imidazol with 4 moles epichlorohydrin, corresponding to 8.75 g reaction product/liter, there was obtained under the same conditions an extra bright, levelled zinc deposit in the current density range of 1.0 to 5 A/qdm.

We claim:

1. An aqueous alkaline substantially cyanide-free bath for the electrodeposition of zinc, comprising a zinc salt, an alkali hydroxide, and an effective amount of a brightener which is a reaction product of from 1 to 4 moles of a halohydrin selected from the group consisting of an epihalogen hydrin and a glycerol halogen hydrin with from 1 to 2 moles of a heterocyclic compound selected from the group consisting of pyrazol, 1,2,3-triazol, tetrazol, pyridazine, pyrimidine, pyrazine, 1,3,5-triazine, tetrazine, purine, quinoxaline, pteridine, 1,23-oxadiazol, 3-amino-1,2,4-triazol, 1,3,4-thiadazol, 1,2,4-thiadiazine, benzothiadiazine, and 1,2,4-triazol.

2. The bath of claim 1 in which said reaction product has a molecular weight between about 200 and about 100,000.

3. The bath of claim 1 in which said reaction product is present in a concentration from 0.1 to 100 g per liter.

4. The bath of claim 1 in which said reaction product is present in a concentration from 0.5 to 20 g per liter.

5. The bath of claim 1 which contains in addition a compound selected from the group consisting of a bivalent sulfur compound, aliphatic or aromatic aldehydes, ketones or amines, polyvinyl alcohol, polyvinylpyrrolidone, a water soluble protein, a reaction product of a halohydrin with a heterocyclic mononitrogen compound, and a reaction product of a halohydrin with an aliphatic or aromatic amine.

6. The method of electrodepositing a bright, levelled zinc coat on an object which comprises electrodepositing the zinc coating from the bath according to claim 1, operating said bath at a current density between 0.01 and 10 A/qdm, in a temperature range between about 20° and about 40° C, and at a pH value above 12.

* * * * *